US005386761A

United States Patent [19]

Holtgraver

[11] Patent Number: 5,386,761

[45] Date of Patent: Feb. 7, 1995

[54] ROTARY VALVE ACTUATOR

[75] Inventor: Edward G. Holtgraver, Spring, Tex.

[73] Assignee: Savings by Design, Inc., Spring, Tex.

[21] Appl. No.: 76,479

[22] Filed: Jun. 14, 1993

Related U.S. Application Data

[63] Continuation-in-part of Ser. No. 917,155, Jul. 20, 1992, abandoned.

[51] Int. Cl.[6] ..... F01C 9/00

[52] U.S. Cl. ..... 92/120; 92/124; 92/130 R; 251/59; 251/292

[58] Field of Search ..... 92/120, 121, 124, 128, 92/130 R, 67; 251/59, 291, 292, 128, 337; 91/223

[56] References Cited

U.S. PATENT DOCUMENTS

| | | | |
|---|---|---|---|
| 1,077,884 | 11/1913 | Kinney | 92/121 |
| 2,741,702 | 4/1956 | Keen | 92/120 |
| 3,110,228 | 11/1963 | Shramo et al. | 251/59 |
| 3,444,788 | 5/1969 | Sneen | 92/120 |
| 4,628,797 | 12/1986 | Kendall | 92/120 |
| 5,007,330 | 4/1991 | Scobie et al. | 92/130 R |
| 5,044,257 | 9/1991 | Scobie | 92/120 |
| 5,101,862 | 4/1992 | Leete | 251/59 |

FOREIGN PATENT DOCUMENTS

| | | | |
|---|---|---|---|
| 1923857 | 12/1969 | Germany | 92/120 |
| 1270941 | 4/1972 | United Kingdom | 92/121 |
| 130758 | 3/1960 | U.S.S.R. | 92/67 |

*Primary Examiner*—Thomas E. Denion
*Attorney, Agent, or Firm*—Bush, Moseley, Riddle & Jackson

[57] ABSTRACT

A valve actuator with an arcuate piston disposed within a housing including a side wall having a partition and two end plates whereby when joined, the housing forms a first and a second compartment. An arcuate piston travels between the compartments via an opening in the partition in an oscillating manner. A removable piston assembly enables removing the arcuate piston, output shaft and lever arms supporting the piston in order to remove the output shaft or to engage a spiral spring connecting the output shaft with the housing. The spiral spring may be pretensioned by winding before inserting the piston assembly into the housing. Fluid pressure applied to either compartment urges movement of the arcuate piston into the opposite compartment.

20 Claims, 3 Drawing Sheets

FIG. 6
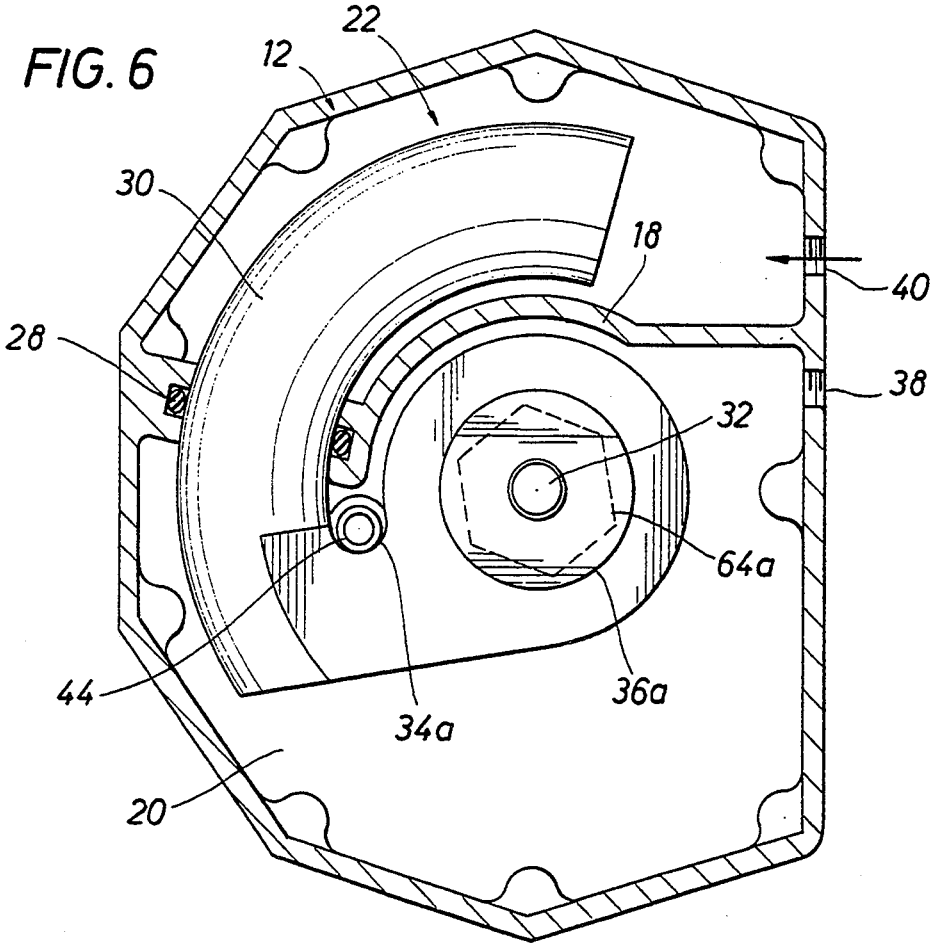
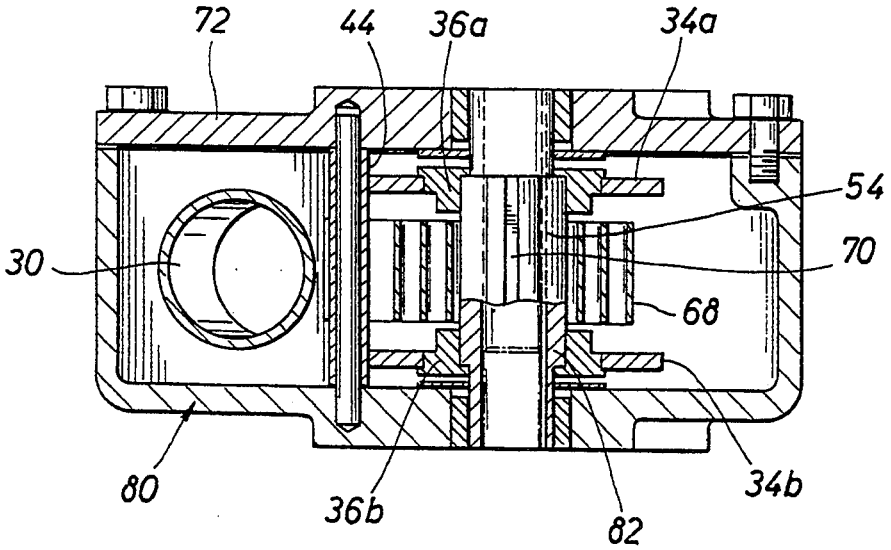
FIG. 7

ROTARY VALVE ACTUATOR

RELATED APPLICATION

This application is a continuation-in-part of U.S. application Ser. No. 07/917,155 filed Jul. 20, 1992 and abandoned in favor hereof.

FIELD OF THE INVENTION

The present invention relates generally to rotary valve actuators, and particularly to a valve actuator that rotates the shaft or stem of a valve through about 90° by means of an arcuate piston in order to open and close the valve.

BACKGROUND OF THE INVENTION

Rotary valve actuators can be double or single-acting devices. A double-acting rotary valve actuator is driven by fluid pressure entering a first chamber to move a piston and valve shaft in one rotational direction, or by fluid pressure entering a second chamber to move the piston and shaft in the opposite rotational direction. A single-acting rotary valve actuator is one having a spring mechanism to rotate the valve shaft in one direction, while fluid pressure, in the form of pressurized air, water, or hydraulic fluid, rotates the piston and valve shaft in the other direction.

Nearly all commercially available rotary valve actuators convert the linear motion of a piston or diaphragm to rotary motion of the valve by means of a lever, gear, or yoke mechanism. In these actuators the forces generated by the fluid pressures on the piston act through the mechanisms to cause rotary motion of the actuator and valve shafts. Reactions to the rotational forces cause side loading forces to act upon the piston cylinder sidewall and lever, gear or yoke mechanism. These side loading forces increase the friction between the components. This friction, plus the necessarily imperfect fit between moving components, cause a reduction in the actuator's efficiency, cycle life, and valve positioning accuracy.

One type of rotary valve actuator that utilizes direct rotary motion is known as a vane-type actuator. It uses a paddle mounted in an offset position on a shaft. Fluid pressures acting on the paddle move the paddle along an arcuate path and rotate the valve shaft. The vane-type rotary actuator, while simplistic, is noted for the great amount of leakage that occurs between the paddle housing and the paddle. Additionally, the vane-type rotary actuator could only be converted from a double-acting actuator to a single-acting actuator by employing a separate external spring-return device connected to the actuator.

Rotary actuators which utilize arcuate pistons to effect direct rotary movement of an output shaft provide an alternative to the linear-to-rotary type actuators and to the vane-type actuators. Unlike linear-to-rotary actuators, the rotary valve actuators which utilize arcuate pistons have no lost motion, have no side loading, and therefore have higher operating efficiencies, longer service life and improved positioning accuracy. Unlike vane-type actuators, arcuate piston type rotary actuators have practically no leakage problems and can achieve single action operation with a spring installed within the actuator housing.

The problems experienced with direct acting rotary valve actuators were partially overcome by Scobie as disclosed in U.S. Pat. No. 5,007,330, which issued Apr. 16, 1991. Scobie addressed the sealing problems known to occur with direct acting rotary valve actuators by utilizing an arcuate piston and by eliminating the use of a body housing that is split along the horizontal center axis. The housing of the actuator disclosed by Scobie consists of two sections that join to the side thereof. This housing construction improved the ability to achieve a tight seal between the housing sections as well as between the piston and the housing. However, Scobie employed a single-acting rotary valve actuator having a spring return mechanism that is mounted in an elongated tube that extends to the side of the housing, and which is quite cumbersome. His disclosure requires that a spring strap pass from the spring return mechanism through an opening in the actuator housing to the valve shaft. The requirement for an additional seal at this point is not eliminated. Further, the structure of the housing disclosed in the Scobie patent prohibits one from being able to economically change the type of output shaft, for example, to replace a female output shaft with a male output shaft. The construction of the housing will not enable the insertion of an integrally connected male shaft and piston assembly as there will not be room to maneuver the male shaft and piston assembly into the housing. An additional problem with changing output shafts is that either must be placed into an integral female shaft of a larger internal diameter. Therefore, them would be lost motion between the actuator components.

It is an object of this invention to provide a new and improved actuator housing that allows a complete piston assembly, including the arcuate piston, its output shaft and its lever arms to be inserted and removed from the housing.

It is a further object of this invention to provide a single-acting rotary valve actuator having an arcuate piston assembly that includes a spring means that can be wound to the desired tension before the piston assembly is mounted in the actuator housing and which spring means is combined with the arcuate piston assembly, and thereby causes no change in the external dimension or shape of the actuator.

Another object of the invention is to provide a new and improved rotary valve actuator where a spring having a variable amount of bias force holds a valve element in its normally-closed position, and where means including an arcuate piston is used to rotate the valve element to its open position.

Another object of the invention is to provide a new and improved rotary valve actuator having a spring loaded piston assembly which may be first inserted into its housing, after which one end of the spring may be secured to the housing of the actuator, such that the spring housing connection forces the piston assembly into a closed position within its housing.

SUMMARY OF THE INVENTION

These and other objects are attained in accordance with the concepts of the present invention through the provision of a rotary valve actuator including a housing having side walls and end walls enclosing a hollow space and having a detachable end plate to provide access to the hollow space. The housing has aligned openings which receive an output shaft that extends across the hollow space, and a partition extends thereacross to divide the space into first and second compartments. A piston assembly which is positioned in the housing includes an arcuate piston member, the output shaft, and lever arms which connect the piston member to the shaft. As the piston member moves along an arcuate path, it passes in sealing engagement through an opening in the partition. In the case of a double-acting actuator, fluid pressure is applied to one compartment while the opposite compartment is exhausted, and vice-versa. For single acting applications, fluid pressure is supplied to only one compartment to overbalance a spring which tends to close the valve.

When the detachable sidewall is removed, the piston assembly can be removed from, and positioned into, the first compartment. While removed, a spring which is wound around the output shaft and having an end that is temporarily engaged with the lever arms can be wound to predetermine the torque that it applies to the output shaft. Clutch bushings which mount the output shaft in the lever arms have polygonal or other non-circular shapes which engage companion shapes on both the output shaft and the lever arms to provide a driving connection when fully assembled. To wind the spring, these bushings are shifted outward to align circular portions thereof with the polygonal openings in the lever arms, which allows the output shaft to be rotated relative to the lever arms. Such rotation winds the spring, whose outer end is held by a tube, or any other shape of device, or a protrusion on the piston or lever, which engages the spring to the lever arms. Then the bushings are shifted toward each other to lock them in place. Next, the piston assembly is placed into its compartment. To anchor the outer end of the spring to the assembled housing, the piston assembly is rotated clockwise until the tube lines up with aligned holes in the sidewalls. A bolt or pin is inserted through one sidewall, then through the tube and finally through a hole in, or into a threaded hole in the other sidewall. Adjustment of a travel stop located in the wall of the actuator removes any gap between the bolt and the tube, thereby causing the forces of the spring to act upon the bolt, the housing and the piston assembly. Application of fluid pressure against one end of the piston overcomes the spring preloading, causing the piston assembly to rotate into the other compartment. When this fluid pressure is decreased or removed, the torsional force of the spring tends to rotate the piston back into the other compartment, and thus will apply a preload closing force to a valve which is connected to the shaft of the actuator.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 6 is a side view of a preferred embodiment of the present invention showing the arcuate piston in the second compartment.

FIG. 7 is an elevational view, partly in section, of an alternate embodiment of the present invention.

DETAILED DESCRIPTION OF PREFERRED EMBODIMENTS

Figure 1:
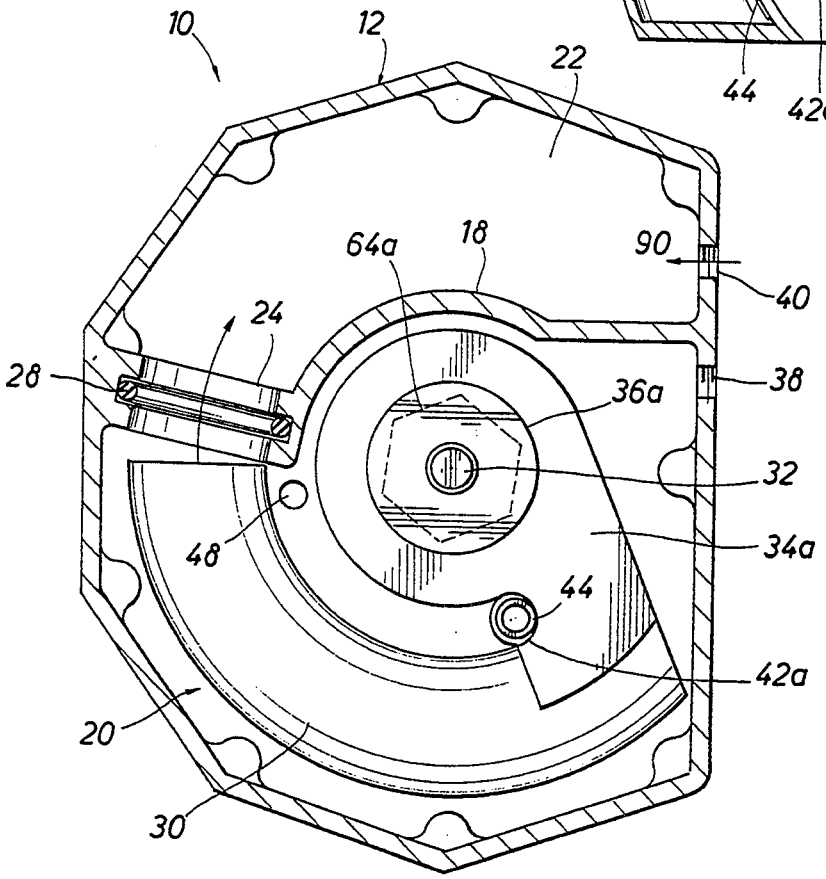
FIG. 1 is a side view, in section, of a preferred embodiment of the present invention showing the arcuate piston in the first compartment.

As shown in FIG. 1, a rotary actuator in accordance with the present invention includes a housing 10 formed of side wall 12, first end plate 14 (FIG. 5), and second end plate 16. The end plates are structurally similar to one another. The space enclosed by the side wall and the end plates is divided by partition 18 (FIG. 1), which extends generally parallel with side wall 12 across the space, into first compartment 20 and second compartment 22. An arcuate piston 30 is arranged to extend through an opening 24 in partition 18 when it is in operating position. A seal ring 28 provides a seal between the outer surfaces of the arcuate piston 30 and the wall of the opening 24 through the partition 18.

Figure 2:
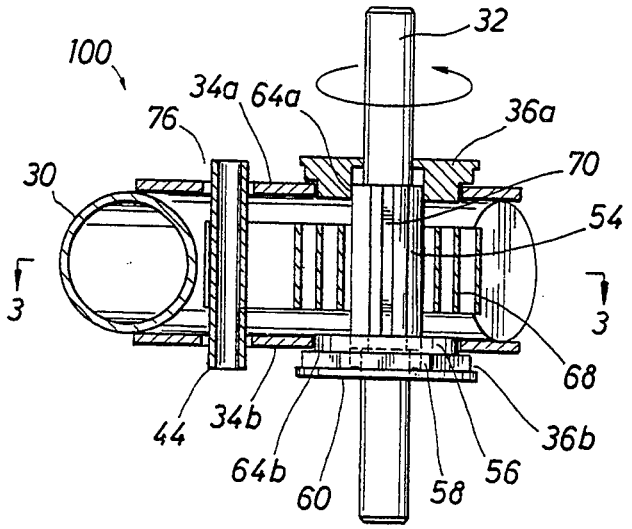
FIG. 2 is a sectional view of the piston assembly showing the perspective of line 2—2 of FIG. 3.
Figure 3:
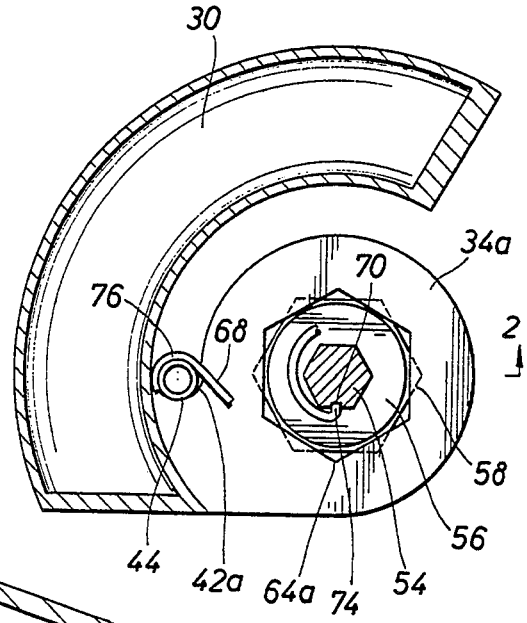
FIG. 3 is a fragmentary view of the piston assembly of the present invention showing the perspective of line 3—3 of FIG. 2.
Figure 4:
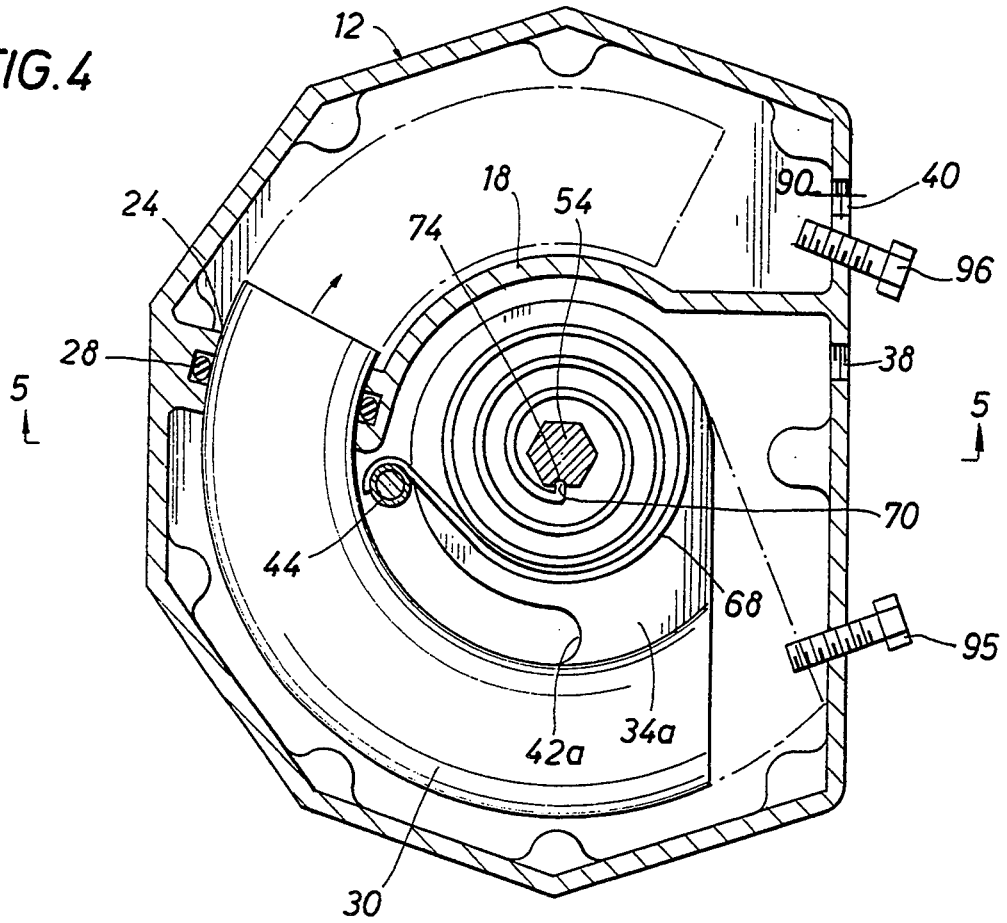
FIG. 4 is a side view, in section, of a preferred embodiment of the present invention having a spring means for urging the piston into the second compartment and viewed from the perspective of line 4—4 in FIG. 5.
Figure 5:
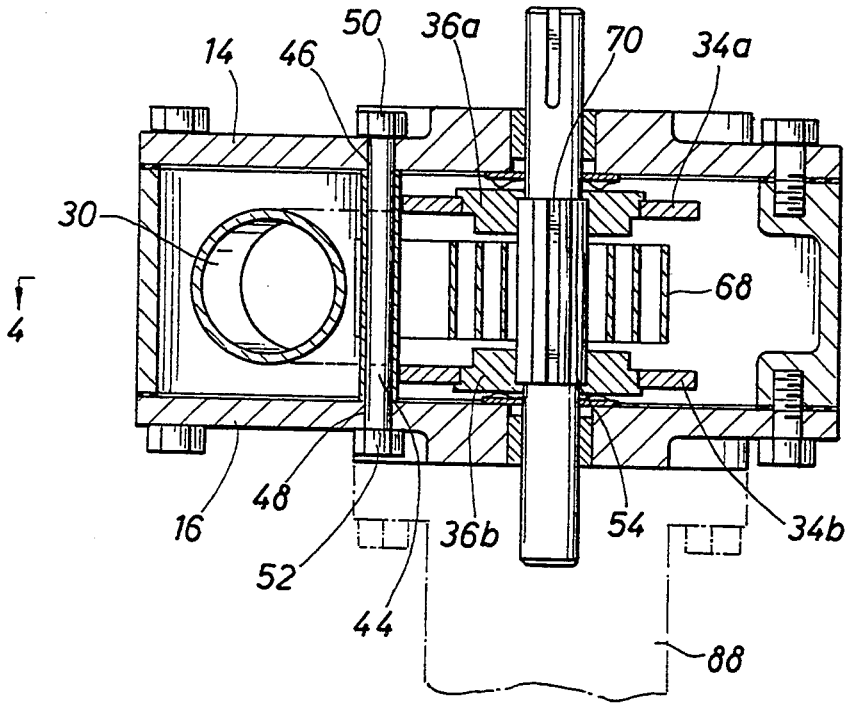
FIG. 5 is an elevational view, in section, of a preferred embodiment of the present invention showing the perspective of line 5—5 of FIG. 4.

The arcuate piston 30 is connected to an output shaft 32 by lever arms **34*a* and 34*b* as shown in FIGS. 2, 5, and 7. Although two lever arms are shown, one skilled in the art will realize that a single lever may be designed to connect the piston to the output shaft. The output shaft 32 has a middle portion 54 with a hexagonal outer surface that is shown in FIGS. 2, 3, 4, 5, and 7. Both of the lever arms 34*a* and 34*b* have a hexagonal opening 64*a* and 64*b*, respectively (64*a* shown in phantom in FIG. 1), to receive bushing members 36*a* and 36*b*, respectively, which mount the inner ends of the lever arms to the shaft 32 for rotation therewith. Bushings 36*a* and 36*b*** will be described more fully hereinafter.

Inlets 38 and 40 which are shown in FIG. 1 allow pressurized air, water, or hydraulic fluid to enter and leave first compartment 20 and second compartment 22, respectively. Provided the seal 28 is engaging the outer surface of the piston 30, pressure entering first compartment 20 moves piston 30 along an arcuate path through opening 24 further into the second compartment 22. The arcuate piston 30 will move from the position shown in FIG. 4 to its farthest position shown in FIG. 6. The introduction of pressure as shown by arrow 90 will force arcuate piston 30 back to its initial position in first compartment 20 as shown in FIG. 4. Alternating the entry of pressure through inlet 38 and inlet 40 produces movement of arcuate piston 30 in an oscillating or reciprocal manner. Alternatively, arcuate piston 30 can be urged from compartment 20 to compartment 22 by spiral spring 68, or other spring means. FIGS. 2, 4, 5, and 7 show spiral spring 68 as it would be positioned and arranged for urging the arcuate piston 30 from the compartment 20 to second compartment 22. Spiral spring 68 fits within housing 10 without necessitating changes to the external dimensions or geometry of the housing. A more detailed description concerning spiral spring 68 will be given below.

Movement of arcuate piston 30 is transferred via levers **34*a* and 34*b* to bushings 36*a* and 36*b* and then to the output shaft 32, whereby output shaft 32 is rotated about its axis. Output shaft 32 is attached to the valve shaft of valve 88, shown in phantom in FIG. 5, for opening and closing the valve as the piston 30** reciprocates.

Lever arms 34*a* and 34*b* have notches 42*a* and 42*b*, respectively, therein to accept a tubular member 44 which extends thereacross. As will be fully explained hereinafter, tubular member 44 is suited for having the outer end 76 of spiral spring 68 or other spring means attached thereto as shown in FIG. 4. Although a tubular member is described, one skilled in the art will realize that other means might be employed, such as protrusions on the piston or levers, to secure the end of the spring, each of which would serve the purpose of holding the end of the spring until later assembly into the housing. In an embodiment of the present invention not utilizing a spring means, and as shown by FIG. 1, the tubular member 44 is not used. When a spiral spring 68 is employed, the tubular member 44 rests in notches 42 in the lever arms until the piston assembly is assembled in the housing 10. Then the arcuate piston 30 is manually rotated clockwise until the tubular member 44 is aligned with a hole 46 in first end plate 14 and hole 48 in second end plate 16, as can be seen in FIG. 5. Then a bolt 50 is inserted through the tube 44 and the holes and is held in place by lock nut 52 or by threads in the lower hole, which anchors the outer end of the spring to the housing. Operational travel limits can be set by means such as adjustable screws 95 and 96 acting as adjustable stops for the respective opposite ends of piston 30.

As shown in FIG. 2, the piston assembly includes arcuate piston 30, the lever arms 34*a* and 34*b*, the output shaft 32 with a hexagonal middle portion 54, and the bushings 36*a* and 36*b*. The entire piston assembly may be removed from housing 10 as a unit when the arcuate piston 30 is positioned in first compartment 20 as shown in FIG. 1, and with the cover plate removed.

Although the following discussion refers to certain elements of the preferred embodiment as being hexagonal shaped, it should be realized that any polygonal or any non-circular shape will be effective for achieving the functional aspects of the invention. FIG. 1 shows output shaft 32 positioned in, and secured to, lever arm 34*a* by bushing 36*a*. Each bushing 36*a*, 36*b* functions in the nature of a clutch and has an outer hexagonal surface 58, a circular surface 56, and an internal hexagonal surface that slides on an end of the middle hexagonal portion 54 of the output shaft 32. When the outer hexagonal surfaces 58 are fitted into correspondingly shaped openings in the lever arms 34*a*, 34*b*, rotation of the arcuate piston 30 is transferred via the lever arms to output shaft 32. When the bushings 36*a* and 36*b* are shifted partly outward, the circular portions 56 are located in the lever arm openings and the output shaft 32 is disengaged from the lever arms 34*a*, 34*b*. Such disengagement allows the spring 68 to be wound by turning the output shaft 32 counterclockwise while the outer end of the spring 68 is stopped by the tube 44. After a selected amount of windings of the spring 68, the bushings 36*a* and 36*b* are pushed back into the hexagonal holes in the levers 34*a* and 34*b* to retain the preset spring torque. If desired, each bushing 36*a*, 36*b* also can have an outer flange 60 having a greater diameter than the perimeter outline of the hexagonal openings 64 to limit inward movement. Disengagement and removal of at least one of the bushings 36*a* or 36*b* from piston assembly 100 allows the output shaft 32 to be slidably inserted or removed from the piston assembly. A shoulder on the bushings and the raised hex portion of the shaft cooperate to create a positive blow-out protection arrangement for the shaft. Such arrangement is important in that an installer of the piston exerts a great amount of axial force against the shaft when installing the actuator on a valve. If the shaft were allowed to slide sideways, it would destroy the integrity of the actuator. Once the piston assembly 100 is installed into the housing, it is rotated clockwise so that the bolt can be inserted through the tube 44 to anchor the spring to the housing.

FIGS. 4 and 5 show more clearly how the spiral spring 68 is mounted. The piston assembly is shown in position in housing 10. The inner end of the spiral spring 68 is slidably engaged in a slot 70 of the hexagonal middle portion 54 of the shaft 32, although other embodiments of this invention may allow engagement of the inner portion of the spiral spring 68 with slots in an extended portion of bushings 36*a* and 36*b*. FIG. 5 shows bushings 36*a* and 36*b* in the engaged position such that the locking section 58 is positioned in hexagonal aperture 64 in lever arm 34. Both the section 58 and circular section 56 secure the output shaft 32 by means of the hexagonal middle portion 54 of the shaft 32 being locked in the inner hexagonal openings of the bushings 36*a*, 36*b*. With the output shaft 32 securely positioned by the bushings 36*a* and 36*b*, the movement of arcuate piston 30 is transferred via the lever arms to output shaft 32. Spiral spring 68 is held in a tensioned or torsional condition when the bushings 36*a* and 36*b* are engaged.

Once the piston assembly is inserted into the housing 10, the piston 30 can be manually rotated through the opening 24. The end plate 14 and the wall 12 will have been assembled. As discussed above, the tubular member 44 also is positioned and engaged in the notches 44 at this time. The piston assembly 100 is rotated to line the tube 44 up with the hole 48 (See FIGS. 1 and 6). FIG. 6 shows arcuate piston 30 in second compartment 22. Bolt 50 is inserted through the tube 44 and the hole 48 and secured therein. Travel stop 96 is now adjusted until it meets the end of piston 30 so as to eliminate the gap between tube 44 and bolt 50. FIG. 4 shows the condition of piston 30 after it has been rotated clockwise by pressure in second compartment 22. Spring 64, now fastened to housing 12, forces piston 30 to the position of FIG. 6 when pressure in second compartment 22 is removed.

FIG. 7 provides an alternative embodiment of the invention having single-end plate 72 and the second end plate cast integral with a side wall to form monolithic side wall structure 80. Yet another alternative would be to permanently affix an end plate to the side wall such that only one end plate 72 would be removable from side wall unit 80. FIG. 7 also demonstrates the use of female shaft 82.

From the foregoing it will be seen that this invention is one well adapted to attain all of the ends and objects hereinabove set forth. It will be understood that certain features and subcombinations are of utility and may be employed without reference to other features and subcombinations. This is contemplated by and is within the scope of the claims. Because many possible embodiments may be made of the invention without departing from the scope thereof, it is to be understood that all matter herein set forth or shown in the accompanying drawings is to be interpreted as illustrative and not in a limiting sense.

What is claimed is:

1. A rotary valve actuator for rotating the valve shaft of a valve between first and second positions comprising a housing having a continuous, open ended side wall and first and second end plates at opposite ends of the side wall to seal the space within the side wall, said end plates having aligned openings to receive and support an output shaft, a partition extending across the space between the end plates dividing the space into first and second compartments, an arcuate piston assembly including an arcuate piston, an output shaft for mounting in the end plates for supporting the arcuate piston for movement along an arcuate path, and lever arm means connecting the piston to the shaft, said assembly located in the housing with the output shaft positioned in the aligned openings in the end plates to support the piston for movement along an arcuate path, an opening in the partition through which the arcuate piston moves as the arcuate piston travels the arcuate path, the arcuate piston assembly being movable into and out of the first compartment in the housing through the open end of the side wall when one of the end plates is removed, and means for urging the arcuate piston to move along the arcuate path and to rotate the valve shaft between first and second positions.

2. The rotary valve actuator of claim 1 in which the means for moving the piston includes means for alternately supplying one of the first and second compartments with fluid under pressure while alternately exhausting fluid from the other compartment to cause the piston to move part of the way into the other compartment.

3. The rotary valve actuator of claim 1 in which the means for moving the piston between first and second positions includes means for supplying one of the compartments with fluid under pressure to move the piston part of the way into the other compartment and spring means for moving the piston back to its original position when the fluid under pressure is exhausted from the one compartment.

4. The rotary valve actuator of claim 3 in which the spring means includes a spiral spring encircling the shaft with one end connected to the shaft and one end connected to the housing to provide a resilient force to resist movement of the piston into the other compartment and to return the piston to its original position when the fluid under pressure is exhausted from the one compartment.

5. A rotary valve actuator for rotating the valve shaft of a valve between first and second positions comprising a housing having a continuous, open ended side wall and first and second end plates at opposite ends of the side wall to seal the space within the side wall, said end plates having aligned openings to receive and support an output shaft, a partition extending across the space between the end plates dividing the space into first and second compartments, an arcuate piston assembly including an arcuate piston, an output shaft for mounting in the end plates for supporting the arcuate piston for movement along an arcuate path, lever arm means connecting the piston to the shaft, said assembly located in the housing with the output shaft positioned in the aligned openings in the end plates to support the piston for movement along an arcuate path, an opening in the partition through which the arcuate piston moves as the arcuate piston travels the arcuate path, the arcuate piston assembly being movable into and out of the first compartment in the housing through the open end of the side wall when one of the end plates is removed, and means for moving the arcuate piston to move along the arcuate path and to rotate the valve shaft between first and second positions including means for supplying one of the compartments with fluid under pressure to move the piston part of the way into the other compartment and spring means for moving the piston back to its original position when the fluid under pressure is exhausted from the one compartment, wherein said spring means includes a spiral spring encircling the shaft with one end connected to the shaft and one end connected to the housing to provide a resilient force to resist movement of the piston into the other compartment and to return the piston to its original position when the fluid under pressure is exhausted from the one compartment, and wherein the arcuate piston assembly includes two spaced lever arms and the spring is positioned on the shaft between the lever arms.

6. The rotary valve actuator of claim 5 in which a portion of the output shaft between said lever arms has a non-round cross-section and the opening in the levers through which the shaft extends is a non-round opening, a locking member having a non-round opening therethrough that mates with the non-round portion of the shaft and an external round portion that mates with the non-round opening in the lever arms to allow the shaft to be rotated to wind the spring to the desired tension after which the non-round portion of the locking member is moved into engagement with the non-round portion of the shaft and the non-round opening in the levers to hold the spring in tension.

7. A removable piston assembly comprising an arcuate piston engaged to an output shaft by a lever arm means, the output shaft having a hexagonal middle portion, the lever arm means having a hexagonal aperture surrounding the output shaft, a means for positioning and securing the lever arm means to the output shaft, the means for positioning and securing the lever arm means having a first, second, and third section, the first section having an opening for accommodating the output shaft, the second section being hexagonal and having a hexagonal aperture for accommodating the hexagonal middle portion of the output shaft, the third section being circular and having a hexagonal aperture for accommodating the hexagonal middle portion of the output shaft, the second section also being of sufficient dimensions such that the second section fits into the hexagonal aperture of the lever arm means.

8. The removable piston assembly of claim 7, additionally comprising a spring means having a first end engaging the hexagonal middle portion of the shaft, the spring means having a second end for engaging an actuator housing when the piston assembly is engaged in the actuator housing.

9. The removable piston assembly of claim 8, wherein the spring means is a spiral spring.

10. The removable piston assembly of claim 8, wherein the second end of the spring means engages a tubular member removably inserted into the actuator housing when the piston assembly is inserted into the actuator housing.

11. The removable piston assembly of claim 7, wherein the output shaft has a non-circular middle portion.

12. The removable piston assembly of claim 11, wherein the second section has a non-circular aperture for accommodating the non-circular middle portion of the output shaft.

13. The removable piston assembly of claim 12, wherein the third section has a non-circular aperture for accommodating the non-circular middle portion of the output shaft.

14. A rotary valve actuator, comprising:

a hollow housing having a side wall and first and second end plates at opposite ends of said side wall, each of said end plates having aligned openings through said end plates a partition extending across said housing and dividing the same into first and second compartments, said partition having an opening therethrough; a piston assembly mountable in said housing via an end of said side wall when an end plate is removed from said housing and including an arcuate piston that is movable through said opening between first and second positions, an output shaft mounted in said aligned openings of said end plates, and lever arm means coupling said piston to said shaft; and means for moving said arcuate piston between said first and second positions including means for supplying a fluid under pressure which acts on said piston means to move it toward said first position, and spiral spring means encircling said shaft and having one end coupled to said shaft and its other end anchored to said housing for moving said piston toward said other position.

15. The actuator of claim 14 further including means for pretensioning said spiral spring to exert a selected torque on said output shaft.

16. A rotary valve actuator, comprising:

a hollow housing having side walls and aligned openings through said side walls;

a partition extending across said housing and dividing the same into first and second compartments, said partition having an opening therethrough;

a piston assembly mounted in said housing and including an arcuate piston that is movable through said opening between first and second positions, an output shaft mounted in said aligned openings, lever arm means coupling said piston to said shaft;

means for moving said arcuate piston between said first and second positions including means for supplying a fluid under pressure which acts on said piston means to move it toward said first position, and spiral spring means encircling said shaft and having one end coupled to said shaft and its other end anchored to said housing for moving said piston toward said other position;

means for pretensioning said spiral spring to exert a selected torque on said output shaft;

wherein said pretensioning means includes clutch means on said output shaft for temporarily disengaging said shaft from said lever arm means to enable rotation of said shaft relative to said lever arms to wind said spring means; and further including means engaging said lever arms for holding the outer end of said spiral spring so that said portion which encircles said output shaft can be wound.

17. A rotary valve actuator, comprising:

a hollow housing having side walls and aligned openings through said side walls;

a partition extending across said housing and dividing the same into first and second compartments, said partition having an opening therethrough;

a piston assembly mounted in said housing and including an arcuate piston that is movable through said opening between first and second positions, an output shaft mounted in said aligned openings, lever arm means coupling said piston to said shaft;

means for moving said arcuate piston between said first and second positions including means for supplying a fluid under pressure which acts on said piston means to move it toward said first position, and spiral spring means encircling said shaft and having one end coupled to said shaft and its other end anchored to said housing for moving said piston toward said other position;

a tube supported by said lever arms and secured to said other end of said spring, and fastener means extending through said tube for anchoring said one end of said spiral spring means to said housing.

18. The actuator of claim 17 wherein said tube is supported within notches of said lever arms.

19. The actuator of claim 17 wherein said fastener means is a bolt securing said tube to said housing.

20. The actuator of claim 17 wherein said tube is supported within notches of said lever arms, and said fastener means is a bolt securing said tube to said housing.

* * * * *